United States Patent [19]

Tucker

[11] Patent Number: 4,709,839

[45] Date of Patent: Dec. 1, 1987

[54] SHOE BUTLER WITH HEEL GRIPPING DEVICE

[75] Inventor: Dalton R. Tucker, San Marcos, Calif.

[73] Assignee: Arcoa Industries, San Marcos, Calif.

[21] Appl. No.: 934,256

[22] Filed: Nov. 24, 1986

[51] Int. Cl.[4] ..... A47G 25/82

[52] U.S. Cl. ..... 223/119; 294/19.1

[58] Field of Search ..... 294/19.1, 2, 104; 223/119, 118

[56] References Cited

U.S. PATENT DOCUMENTS

| | | | |
|---|---|---|---|
| 470,109 | 3/1892 | Dickinson | 223/119 |
| 3,527,492 | 9/1970 | Hollis | 294/19.1 |
| 3,591,226 | 7/1971 | Elmore | 223/119 X |

*Primary Examiner*—Andrew M. Falk
*Attorney, Agent, or Firm*—John J. Murphey

[57] ABSTRACT

A shoe butler, for putting on and taking off one's shoes, having an elongated shaft with an upper handle and a lower shoe horn, a rubber chock held apart from behind the shoe horn by a spring attached to the shaft and band means, operable through a finger-actuable trigger adjacent the handle, to draw the chock in an upwardly arcuate path into sliding contact with the rear of the shoe horn to clasp the rear wall of the shoe therebetween. A tongue extends from a lower end of the shaft to engage the band means as the chock is drawn into contact with the shoe horn to lock the chock tightly against the shoe.

20 Claims, 4 Drawing Figures

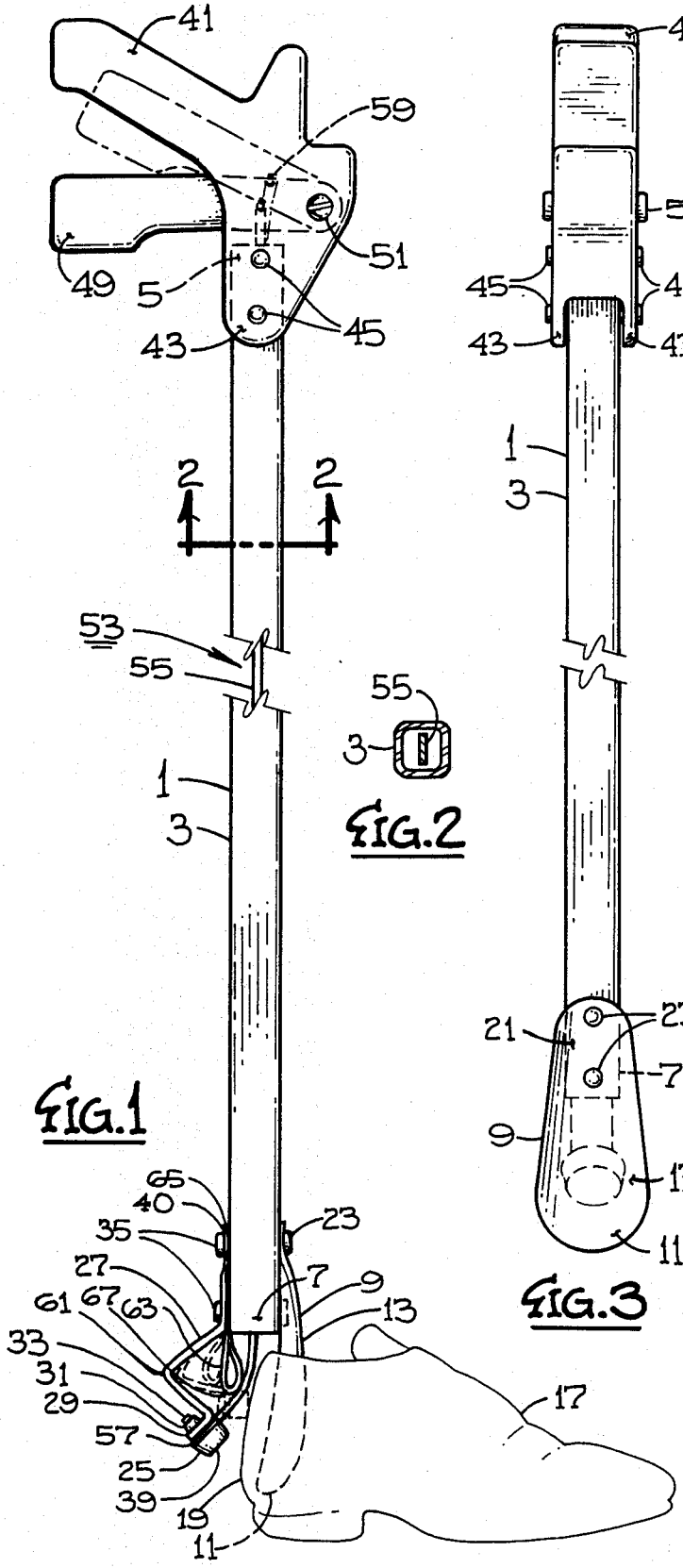
FIG.1
FIG.3
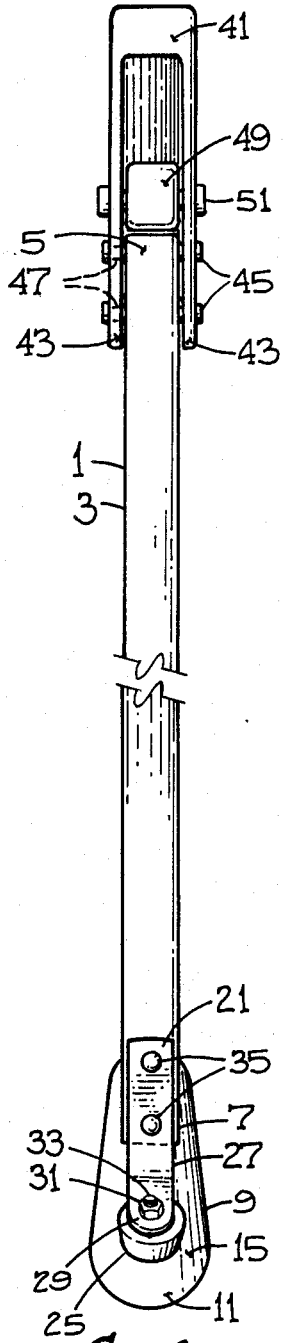
FIG.4
FIG.2

SHOE BUTLER WITH HEEL GRIPPING DEVICE

BACKGROUND OF THE INVENTION

1. Field of the Invention

This invention pertains to the field of hand tools. More particularly, this invention pertains to tools for undertaking manipulative operations spaced apart from the operator's hands, generically known as "butlers". More specifically, this invention pertains to butlers for aiding a person in putting on and taking off their shoes.

2. Description of the Prior Art

There are times and situations wherein an individual cannot directly use his or her hands to undertake a manipulative operation. Instances such as where house keys dropped down through a grate, keys locked in a car and a wallet dropped in a sewer are all instances where direct access to the article is prevented and some retrieval tool is needed. In addition, some people are situated such that their body is somehow unable to undertake manipulative operations due to various maladies such as arthritic conditions in the hands, spinal injuries, and diseases such as polio. Because of these situations, a range of tools, known as "butlers", has been developed to undertake these manipulative operations.

Simply picking up and moving items has been the general subject of most butlers. For instance, U.S. Pat. No. 3,527,492 concerns a tool for use in picking up trash or other items using an elongated shaft having a handle at the upper end and a pair of spring operated fingers at the lower end. Such a tool is successful in picking up small items to be moved from one place to another. However, where the manipulative operation also includes the need to hold the item steady while some other operation is being performed, the prior art has not been so successful.

Particularly where significant grasping power is required, virtually all of the prior art has required in turn significant hand grasping power to be transmitted through mechanical means to provide the grasping strength at the operative or manipulative end of the butler. Where such hand power is insufficient, because of age, arthritis, or other infirmity, the prior art has not been successful in providing a butler-type tool of significant mechanical advantage to overcome the loss of this hand power.

SUMMARY OF THE INVENTION

This invention solves the aforementioned problems of the prior art in that it is a butler for use in undertaking manipulative operations spaced apart from the hands of the operator wherein substantial grasping strength at the operative end is achieved through mechanical advantage so as to relieve the requirement of significant hand power in the operator. This invention is a shoe butler for use in grasping, moving, and aiding an individual in putting the shoes on and in removing the shoes by holding the shoe tightly.

The invention comprises an elongated shaft having a handle at the upper end that includes a finger-actuated trigger and a shoe horn at the lower end having a unique spring-loaded chock spaced apart from behind the shoe horn and further includes means for bringing the chock into contact with the rear of a shoe after the shoe horn has been slipped inside the upper rear heel wall of the shoe. The invention includes a unique abutment that extends from the lower shaft end adapted to engage the chock when it is drawn into contact with the upper rear shoe wall so as to provide significant locking strength to hold the shoe with very little power required from the operator's hand. By this means, the shoe can be tightly clasped and held while the individual slides their foot into the shoe or removes their foot from the shoe whether or not the shoe is tight fitting. Mechanical advantage is achieved by a unique combination of the chock spring and the abutment. The spring contains a uniqe shape to reduce the reduce the required further power in the finger-actuated trigger.

Accordingly, the main object of this invention is a shoe butler that provides significant grasping strength without the need for concomitant significant hand power so as to be more useful to infirm, aged and wheelchair bound persons. Other objects include a bulter that is light weight, easy to manipulate, and capable of grasping a wide variety of objects quickly and tightly holding them. The device is simple in construction, using inexpensive plastic and aluminum materials and is thus priced to be affordable to a wide range of persons. These and other objects of the invention will become more apparent upon reading the description of the preferred embodiment along with the drawings attached hereto. The property rights claimed by the inventor within the scope of the monopoly granted under the United States patent laws may be gleaned from a fair reading of the claims that conclude this specification.

DESCRIPTION OF THE DRAWINGS

FIG. 1 is a vertical side elevational view of the preferred embodiment of this invention showing its' use with a shoe.

FIG. 2 is a cross-sectional view of the center portion of the device taken along lines 2—2 in FIG. 1.

FIG. 3 is a vertical front elevational view of the embodiment shown in FIG. 1 without the shoe.

FIG. 4 is a vertical rear elevational view of the embodiment shown in FIG. 1 without the shoe.

DESCRIPTION OF THE PREFERRED EMBODIMENT

The preferred embodiment of this invention is shown in the figures generally at 1 and is comprised of a shaft or rod 3, preferably straight and hollow, and of thin-walled, rectangular cross-sectional construction as shown in FIG. 2, having spaced-apart upper and lower shaft ends 5 and 7 respectively. A shoe horn 9 is provided, preferably having a curved lower portion 11 with a concave front surface 13, for positioning against a person's heel, and a rear convex surface 15, behind front surface 13 for insertion into a shoe 17 adjacent the rear wall 19 thereof. Shoe horn 9 has an attachable portion 21 that is fastened to lower shaft end 7 with fastening means such as a pair of flat headed rivets 23 in such a manner that shoe horn 9 extends axially outward from lower shaft end 7.

A chock or wedge 25 is positioned behind shoe horn rear surface 15 and held spaced apart therefrom by a short leaf spring 27 attached at its lower end 29 to chock 25 by a nut 31 threadably received on a shaft 33 extending from the rear of chock 25 and attached at its upper end 35 to lower shaft end 7 by fastening means such as a pair of flat head rivets 37. Chock 25 preferably contains a frictional working surface 39 for establishing a non-slip grip as later described; even more preferably, chock 25 is made in the form of a solid button of a frictional material such as rubber or rubber-plastic blend.

Upper shaft end 5 contains a stationary, turned out portion 41 that forms a handle for grasping and manipulating shoe bulter 1. As shown, handle 41 is attached to upper shaft end by a pair of thin handle side plates 43 that engage opposite surfaces of shaft 3 and are attached thereto by fastening means such as oppositely positioned pairs of short, flat headed rivets 45 passing through respective apertures 47 formed in said side walls 45 and the walls of shaft 3. A moveable, finger-actuable trigger 49 extends outward from upper shaft end 5 forward and spaced apart from handle 41 and is pivotally attached to handle side walls 43 at a trigger pivot 51, passing through handle side walls 43, on the opposite side of upper shaft end 5 from handle 41 so as to provide a large swing distance for trigger 49.

Means 53 is provided, along with trigger 49, for drawing chock 25 into contact with rear shoe horn surface 15, after shoe horn 9 is slipped into a shoe, to hold or clasp shoe butler 1 firmly to shoe 17. As shown, means 53 includes a flexible band 55 passing axially along the inside of shaft 3, of terminal length attached at a lower terminal end 57 to chock 25 and attached at its upper terminal end 59 to trigger 49 near pivot 51. When trigger 49 is moved from its position by finger actuation or "squeezing", and is swung against handle 41, as shown in dotted outline in FIG. 1, band 55 is drawn upward pulling chock 25 in an upwardly arcuate path and into sliding contact with rear shoe horn surface 15 so as to clasp shoe wall 19 tightly against shoe horn 9 to allow a person to put on and take off their shoes. This upwardly arcuate motion is important in that it makes chock 25 push upward on shoe rear wall 19 and force shoe horn 9 down into shoe 17. With shoe horn 9 made of a smooth metal, such as stainless steel, and chock working surface 39 being frictional in character, the arcuate motion tends to drive shoe horn 9 deeper within shoe 17 thus causing a tightening action between the two.

Preferably, spring 27 is formed into an L-shaped having a mid span pivot crease 61 to reduce the amount of power necessary to finger-actuate trigger 49 and move chock 25 into contact with rear convex shoe horn surface 15. Because of the L-shaped spring, chock 25 is brought toward rear surface 15 along an arcuate path as shown in dotted lines in FIG. 1 and comes into sliding contact with rear shoe horn surface 15.

To insure a continuous tight fit between chock frictional surface 39 and shoe horn rear surface 15, or against anything positioned therebetween such as rear shoe wall 19, without the need for a continual tight grip between handle 41 and trigger 49, a tongue 63 is provided, extending outward from lower shaft end 7 to lock said chock thereagainst. Tongue 63 is connected at its upper end 65 to lower shaft end 7 on the opposite side thereof from shoe horn 9 and most conveniently adjacent upper spring end 40 and fastened thereto with the same rivets 35. Tongue 63 terminates at lower abutment end 67 that is adapted to engage band 55 as chock 25 is pulled into sliding contact with rear shoe horn surface 15 and to prevent chock 25 from moving away from shoe horn 9.

In operation, shoe butler 1 is grasped by handle 41 and manipulated to cause shoe horn 9 to slide into a shoe, either on or off one's foot, along rear shoe wall 19. Thereafter, the fingers of the hand squeeze trigger 49 against handle 41 to draw band 55 upward and pull chock 25 into an arcuate, upswinging path into sliding engagement with the outside of rear shoe wall 19. As band 55 is drawn into seating engagement with tongue 63 chock 25 seats against shoe rear wall 19 to prevent any relative or loosening motion between the elements while the person puts on or takes off their shoe. Thereafter, release of trigger 49 from its position adjacent handle 41 will allow spring 27 to move chock 25 along a return arcuate journey back out of contact and spaced apart from shoe horn 9 so as to allow removal of shoe horn 9 from the shoe.

While describing the preferred embodiment of my invention hereinabove, I do not relinquish nor release any other embodiment or modification that fails within the scope and spirit of the following claims.

What is claimed is:

1. A shoe butler comprising:

(a) an elongated shaft terminating at spaced apart upper and lower ends;

(b) a shoe horn extending from said lower shaft end for insertion into a shoe adjacent an upper rear wall thereof;

(c) a chock held apart from behind said shoe horn by a spring attached to said shaft;

(d) means, including a handle with a finger-actuable trigger at said upper shaft end, for drawing said chock along an upwardly arcuate path into sliding contact with said shoe horn to clasp the upper rear shoe wall therebetween; and (e) a tongue, extending from said lower shaft end, to engage said means as said chock is drawn into contact with said shoe horn, to lock said chock thereagainst for manipulating the shoe.

2. The shoe butler of claim 1 wherein said shaft is straight.

3. The shoe butler of claim 1 wherein said shaft is hollow.

4. The shoe butler of claim 1 wherein said shaft is straight and hollow.

5. The shoe butler of claim 1 wherein said shaft is straight, hollow and of a thin-walled rectangular cross-section.

6. The shoe butler of claim 1 wherein said shoe horn is curved to fit the curvature of the upper rear wall of the shoe.

7. The shoe butler of claim 1 wherein said chock has a frictional surface adjacent its contact with said shoe horn.

8. The shoe butler of claim 1 wherein said chock comprises a rubber button.

9. The shoe butler of claim 1 wherein said spring is a flat spring.

10. The shoe butler of claim 1 wherein said spring is a flat, L-shaped spring attached between said lower shaft end and said chock.

11. The shoe butler of claim 1 wherein said means includes a flexible band attached between said trigger and said chock.

12. The shoe butler of claim 1 wherein said shaft is hollow and said means comprises a flexible band passing inside said shaft from said finger-actuable trigger to said chock.

13. The shoe butler of claim 1 wherein said handle containing a finger-actuable trigger comprises:

(a) a stationary handle portion extending outward from said upper shaft end;

(b) a moveable trigger portion extending outward from said upper shaft end and biased apart from said handle portion; and, (c) a pivot on which said trigger portion is mounted, located apart from said shaft opposite said handle and trigger portions, to provide a large swing distance for said trigger portion.

14. The shoe butler of claim 1 wherein said means includes a flexible band attached to said chock and said tongue extends between said band and said spring to engage said band and said spring.

15. A shoe bulter comprising:

(a) an elongated hollow shaft terminating at spaced-apart upper and lower ends;

(b) a shoe horn extending from said lower shaft end and having a concave front surface, to fit the curvature of shoe heel, and a convex upper rear surface, to fit the curvature of the rear wall adjacent the shoe heel;

(c) a chock held apart from said convex rear surface by a spring attached to said shaft;

(d) means, including a handle with a finger-actuable trigger at said upper shaft end for drawing said chock along an upwardly arcuate path into sliding contact with said shoe horn to clasp the upper rear shoe wall therebetween; and, (e) a tongue, extending from said lower shaft end, to engage said means, as said chock is drawn into contact with said shoe horn, to lock said chock thereagainst for manipulating the shoe.

16. The shoe butler of claim 15 wherein said chock has a frictional surface adjacent its contact with said shoe horn.

17. The shoe butler of claim 15 wherein said chock comprises a rubber button.

18. The shoe butler of claim 15 wherein said spring is a flat, L-shaped spring attached between said lower shaft end and said chock.

19. The shoe butler of claim 15 wherein said means includes a flexible band passing inside said shaft from said fingeractuable trigger to said chock.

20. A shoe butler comprising:

(a) an elongated, straight hollow shaft terminating at spaced-apart upper and lower ends;

(b) a shoe horn extending from said lower shaft end and having a concave front surface, to fit the curvature of a shoe heel, and a convex upper rear surface, to fit the curvature of the rear wall adjacent the shoe heel;

(c) a rubber chock held apart from said convex rear shoe horn surface by a flat, L-shaped spring connected between said lower shaft end and said chock;

(d) a flexible band connected between said chock and a finger-actuable, pivotal trigger, passing axially inside said shaft, biased outward from a handle at said upper shaft end for drawing, upon squeezing of said trigger, said chock along an upwardly arcuate path into sliding contact with said shoe horn, to clasp the upper rear shoe wall therebetween; and, (e) a tongue, extending from said lower shaft end and attached thereto, terminating in an abutment edge to engage said band as said chock is brought into contact with said shoe horn to prevent any relative motion therebetween while said shoe bulter is being used.

* * * * *